US008531340B2

(12) United States Patent
Tsai et al.

(10) Patent No.: US 8,531,340 B2
(45) Date of Patent: Sep. 10, 2013

(54) MULTI-BAND ANTENNA MODULE

(75) Inventors: Tiao-Hsing Tsai, New Taipei (TW); Chao-Hsu Wu, Luzhu Township, Taoyuan County (TW); Yuan-Chang Chao, Dayuan Township, Taoyuan County (TW); Tsung-Ming Kuo, Tainan (TW)

(73) Assignee: Quanta Computer, Inc., Tao Yuan Hsien (TW)

( * ) Notice: Subject to any disclaimer, the term of this patent is extended or adjusted under 35 U.S.C. 154(b) by 230 days.

(21) Appl. No.: 13/099,992

(22) Filed: May 3, 2011

(65) Prior Publication Data

US 2012/0146858 A1 Jun. 14, 2012

(30) Foreign Application Priority Data

Dec. 13, 2010 (TW) ..... 99143470 A

(51) Int. Cl.
*H01Q 1/24* (2006.01)

(52) U.S. Cl.
USPC ..... 343/702

(58) Field of Classification Search
USPC ..... 343/702, 700 MS, 129, 810, 793
See application file for complete search history.

(56) References Cited

U.S. PATENT DOCUMENTS

2007/0171130 A1* 7/2007 Chung et al. ..... 343/700 MS
2009/0243943 A1* 10/2009 Mumbru et al. ..... 343/702
2011/0263217 A1* 10/2011 Chiu et al. ..... 455/129

* cited by examiner

*Primary Examiner* — Thien M Le
(74) *Attorney, Agent, or Firm* — Brinks Hofer Gilson & Lione

(57) ABSTRACT

A multi-band antenna module is disposed in a housing of an electronic device. The housing has a grounding plane disposed therein and includes a metal frame part having two ends electrically connected to opposite side edges of the grounding plane. The multi-band antenna module includes a conductor, a substrate, a grounding section, and a first radiator section. The conductor is to be coupled across the metal frame part and the grounding plane so as to cooperate with the grounding plane and a portion of the metal frame part to form a closed loop thereamong, in which the substrate is disposed. The first radiator section and the grounding section are disposed on the substrate, with the grounding section to be coupled electrically to the grounding plane. A portion of the first radiator section is disposed to cooperate with the closed loop to resonate in a first frequency band. Another portion of the first radiator section is disposed to cooperate with the grounding section to resonate in a second frequency band.

9 Claims, 8 Drawing Sheets

MULTI-BAND ANTENNA MODULE

CROSS-REFERENCE TO RELATED APPLICATION

This application claims priority of Taiwanese Application No. 099143470, filed on, Dec. 13, 2010.

BACKGROUND OF THE INVENTION

1. Field of the Invention

The present invention relates to a multi-band antenna module, more particularly to a multi-band antenna module to be disposed in a notebook computer.

2. Description of the Related Art

Conventional antennas for notebook computers are usually mounted in spaces provided inside frame parts of displays of the notebook computers. In order to avoid radiation interference of the conventional antennas, frame parts of the displays are usually made of an insulating material.

However, frame parts of some notebook computers are nowadays made of metal, and as a consequence, the conventional antennas employed in the notebook computers having metal frame portions have a relatively low efficiency. Therefore, it is desirable to have antennas suitable for notebook computers having metal frame parts.

SUMMARY OF THE INVENTION

Therefore, the object of the present invention is to provide a multi-band antenna module capable of operating at various frequency bands, and applicable to a notebook computer with a metal frame part.

Accordingly, a multi-band antenna module of this invention is adapted to be disposed in a housing of an electronic device. The housing has a grounding plane disposed therein and includes a metal frame part having two ends electrically connected to two opposite side edges of the grounding plane. The multi-band antenna module comprises a conductor, a substrate, a grounding section, and a first radiator section. The conductor is to be coupled across the metal frame part and the grounding plane so as to cooperate with the grounding plane and a portion of the metal frame part to form a closed loop thereamong. The substrate is to be disposed in the closed loop. The grounding section is disposed on the substrate, is to be coupled electrically to the grounding plane, and has a grounding point. The first radiator section is disposed on the substrate, is spaced apart from the grounding section, and has a feed-in end for feeding of radio frequency signals. A portion of the first radiator section is parallel to a portion of the closed loop and cooperates with the closed loop to resonate in a first frequency band. Another portion of the first radiator section is parallel to and cooperates with the grounding section to resonate in a second frequency band.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
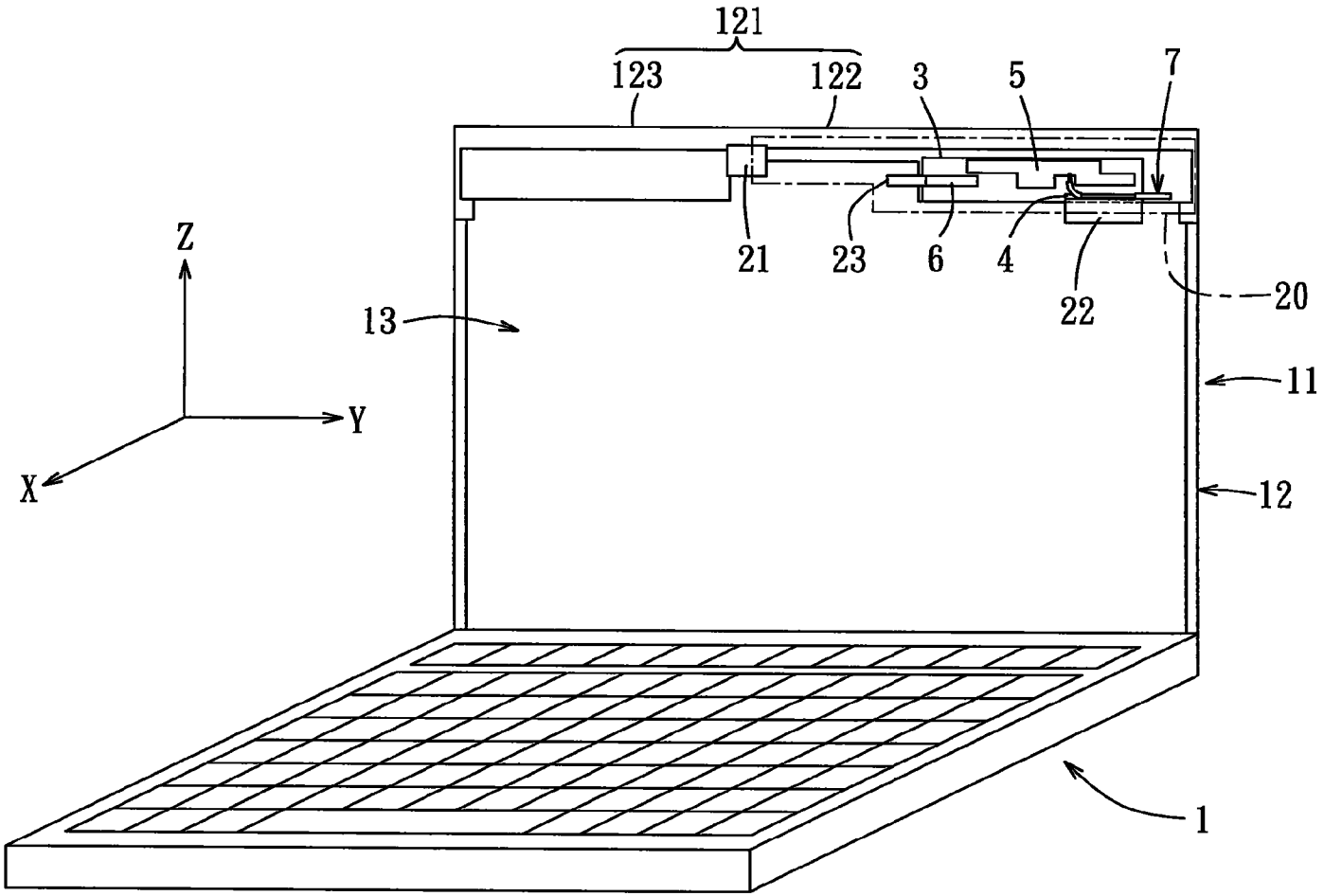
FIG. 1 is a perspective view of a notebook computer provided with a preferred embodiment of a multi-band antenna module according to the present invention.
Figure 2:
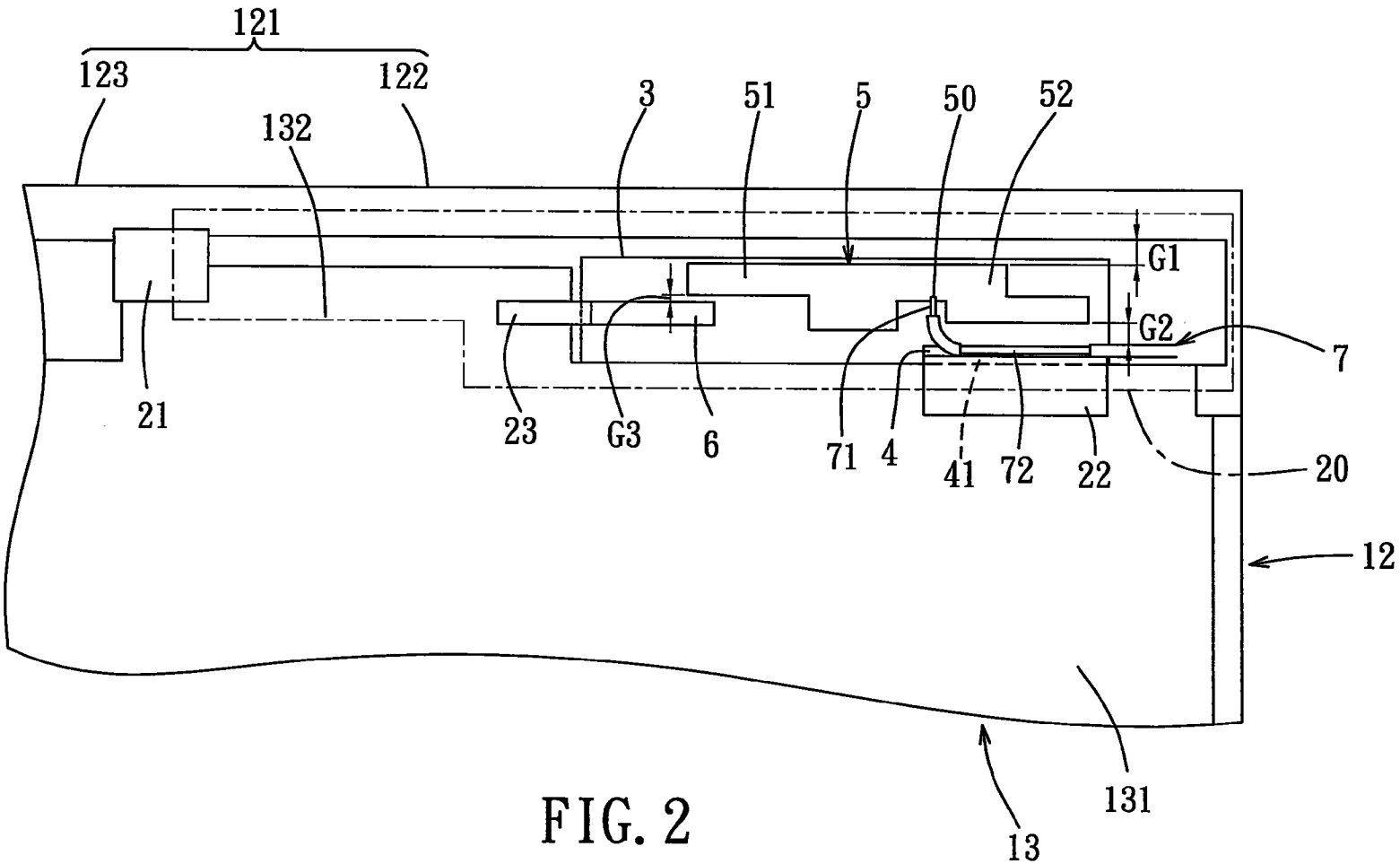
FIG. 2 is a fragmentary schematic diagram of the preferred embodiment.

Referring to FIGS. 1 and 2, a preferred embodiment of a multi-band antenna module of the present invention is adapted to be disposed in a housing 12 of an electronic device 1. The electronic device 1 is a notebook computer and includes a display 11 having the housing 12. The housing 12 has a grounding plane 13 disposed therein and includes an inverted U-shaped metal frame part 121 having two ends electrically connected to two opposite side edges of the grounding plane 13. In this embodiment, the grounding plane 13 is an aluminum foil. The multi-band antenna module comprises a conductor 21, a substrate 3, a grounding section 4, a first radiator section 5, a second radiator section 6, and a coaxial transmission cable 7.

The conductor 21 is to be coupled across the metal frame part 121 and the grounding plane 13. In this embodiment, the grounding plane 13 has a rectangular main portion 131 and a protruding portion 132 extending from an upper end of the main portion 131. The conductor 21 is coupled across the metal frame part 121 and the protruding portion 132. Further, the metal frame part 121 has an L-shaped first segment 122 extending from a junction between the metal frame part 121 and the conductor 21 in a first direction and an L-shaped second segment 123 extending from the j unction between the metal frame part 121 and the conductor 21 in a second direction different from the first direction. The conductor 21 cooperates with the main portion 131 and the protruding portion 132 of the grounding plane 13, and the first segment 122 of the metal frame part 121 to form a closed loop 20 thereamong.

The substrate 3 is to be disposed in the closed loop 20. The grounding section 4 is disposed on the substrate 3, is to be coupled electrically to the grounding plane 13, and has a grounding point 41. In this embodiment, the grounding section 4 extends along a straight line, is disposed at a lower end of the substrate 3, and is coupled electrically to the grounding plane 13 via a conductor 22.

The first radiator section 5 is disposed on the substrate 3, is spaced apart from the grounding section 4, and has a feed-in end 50 for feeding of radio frequency signals. A portion of the first radiator section 5 is parallel to a portion of the closed loop 20 and is mutually coupled to the closed loop 20 so as to cooperate with the closed loop 20 to resonate in a first frequency band, and another portion of the first radiator section 5 is parallel to and is mutually coupled to the grounding section 4 so as to cooperate the grounding section 4 to resonate in a second frequency band.

In this embodiment, the first radiator section 5 includes a first radiator portion 51 extending from the feed-in end 50 in the second direction, i.e., a right-to-left direction in the drawings, and a second radiator portion 52 extending from the feed-in end 50 in the first direction, i.e., a left-to-right direction in the drawings.

The first radiator portion 51 of the first radiator section 5 is disposed such that the portion of the closed loop 20 is parallel to, is adjacent to, and is mutually coupled to the first radiator portion 51 to resonate in the first frequency band. The second radiator portion 52 of the first radiator section 5 is disposed such that the grounding section 4 is parallel to, is adjacent to, and is mutually coupled to the second radiator portion 52 to resonate in the second frequency band. In this embodiment, the second radiator portion 52 has a length shorter than that of the first radiator portion 51.

More specifically, the first radiator portion 51 of the first radiator section 5 is disposed parallel to and to form a first clearance (G1) with the first segment 122, such that the first radiator portion 51 cooperates with the first segment 122 to resonate in the first frequency band. The second radiator portion 52 of the first radiator section 5 is disposed to form a second clearance (G2) with the grounding section 4, such that the second radiator portion 52 cooperates with the grounding section 4 to resonate in the second frequency band.

The second radiator section 6 is substantially parallel to the first radiator portion 51 and is to be electrically coupled to the grounding plane 13. In this embodiment, the second radiator section 6 extends along a straight line in the first direction, and is coupled electrically to the protruding portion 132 of the grounding plane 13 via a conductor 23. The second radiator section 6 is disposed to form a third clearance (G3) with the first radiator portion 51 of the first radiator section 5 and is mutually coupled to the first radiator portion 51 so as to cooperate with the first radiator portion 51 to resonate in a third frequency band.

The coaxial transmission cable 7 has a first signal line 71 electrically connected to the feed-in end 50 and a second signal line 72 electrically connected to the grounding point 41. In this embodiment, the first signal line 71 is a positive signal line, and the second signal line 72 is a negative signal line.

It should be noted that the conductors 21, 22, 23 are conductive cooper foils in this embodiment.

Figure 3:
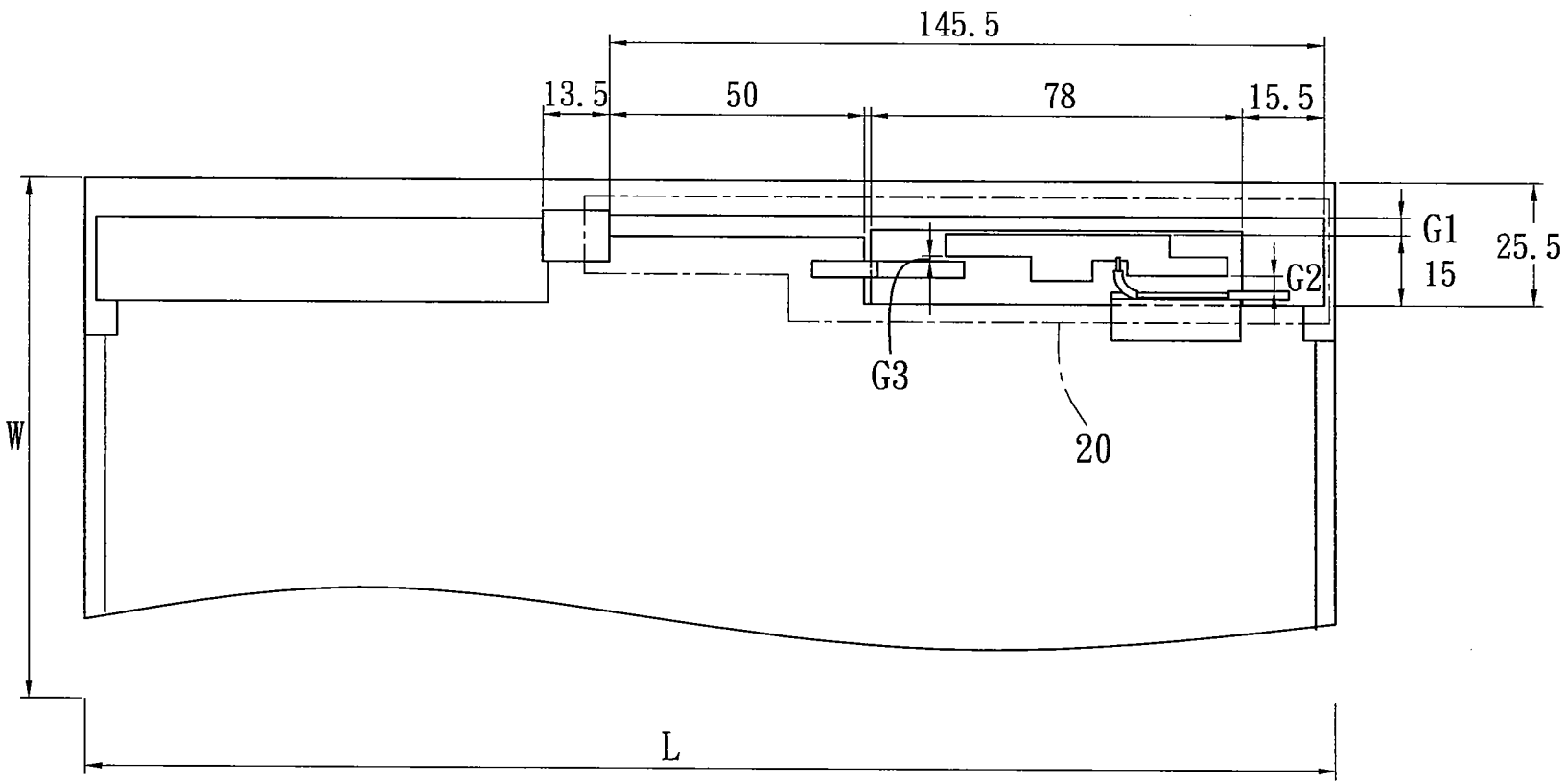
FIG. 3 is a fragmentary schematic diagram illustrating dimensions of the preferred embodiment.

Further referring to FIG. 3, the detailed dimensions (in mm) of the multi-band antenna module of the preferred embodiment are shown. The housing 12 of the electronic device 1 has a dimension of length L=275 mm, and a dimension from a top edge of the metal frame part 121 to a bottom edge of the grounding plane 13 is width W=195 mm. The multi-band antenna module has dimensions of the first clearance (G1)=3.2 mm, the second clearance (G2)=1 mm, the third clearance (G3)=5 mm, and a thickness of the substrate 3 is equal to 0.6 mm (not shown).

With the dimensions shown in FIG. 3, the first frequency band ranges from 824 MHz~960 MHz, the second frequency band ranges from 1710 MHz~1880 MHz, and the third frequency band ranges from 1850 MHz~2170 MHz. Accordingly, the preferred embodiment can operate in frequency bands GSM850, GSM 900, DCS1800, PCS1900, and UMTS within the Wireless Wide Area Network (WWAN) communication protocol.

Figure 4:
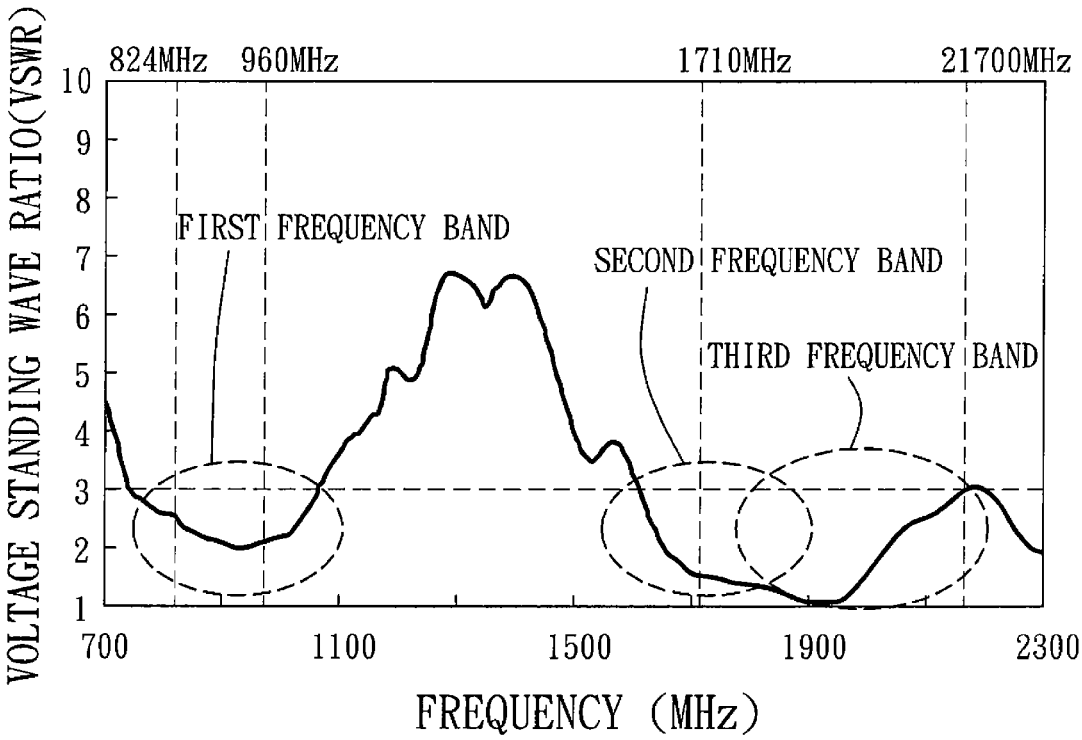
FIG. 4 is a Voltage Standing Wave Ratio (VSWR) plot showing VSWR values of the preferred embodiment.
Figure 5:
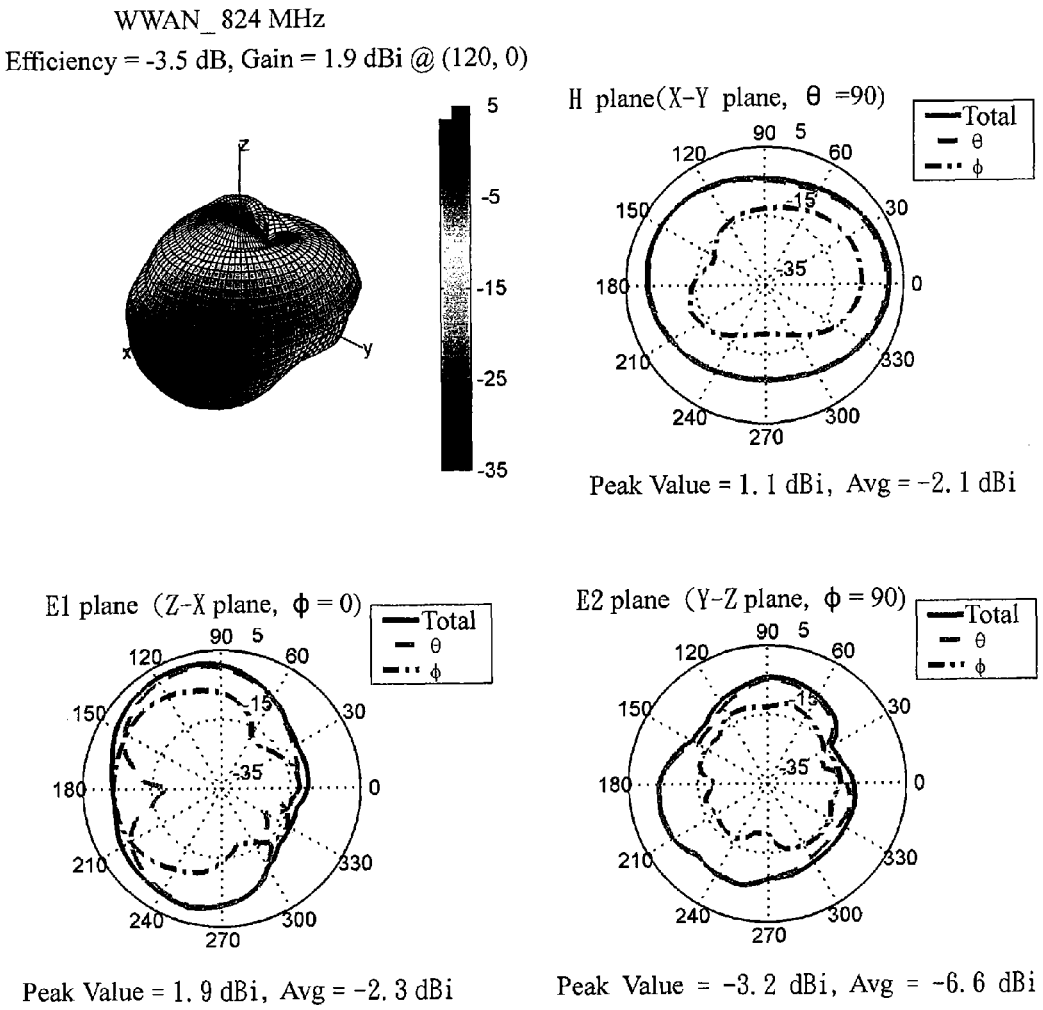
FIG. 5 illustrates radiation patterns of the preferred embodiment operating at 824 MHz.
Figure 6:
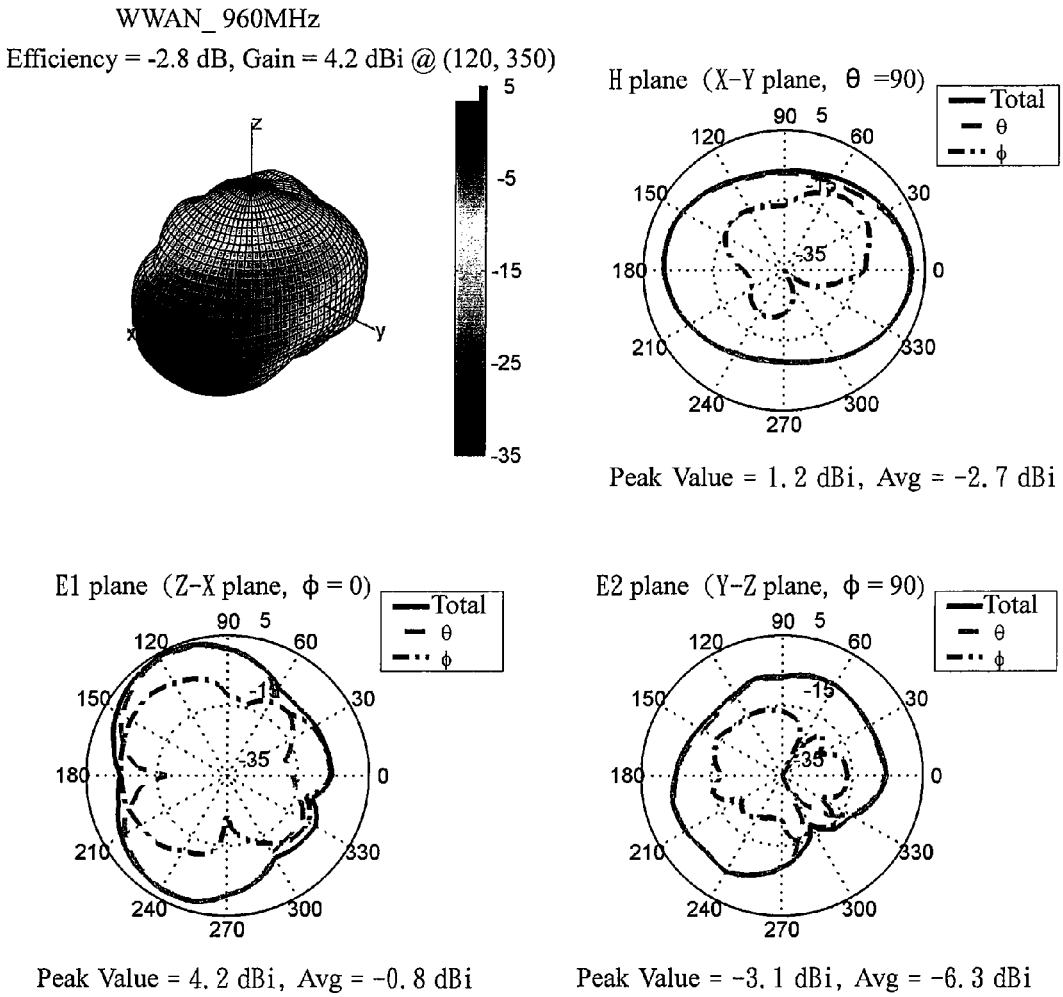
FIG. 6 illustrates radiation patterns of the preferred embodiment operating at 960 MHz.
Figure 7:
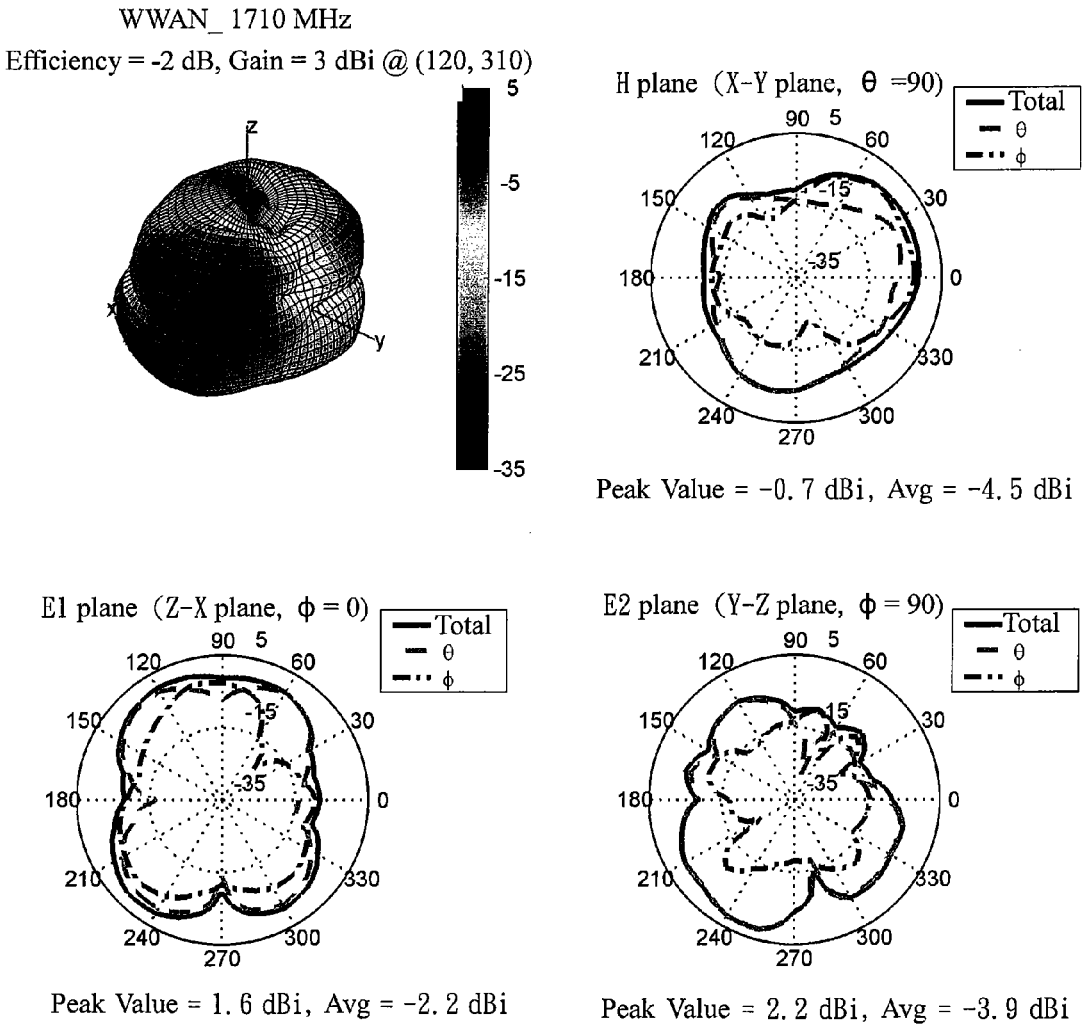
FIG. 7 illustrates radiation patterns of the preferred embodiment operating at 1710 MHz.
Figure 8:
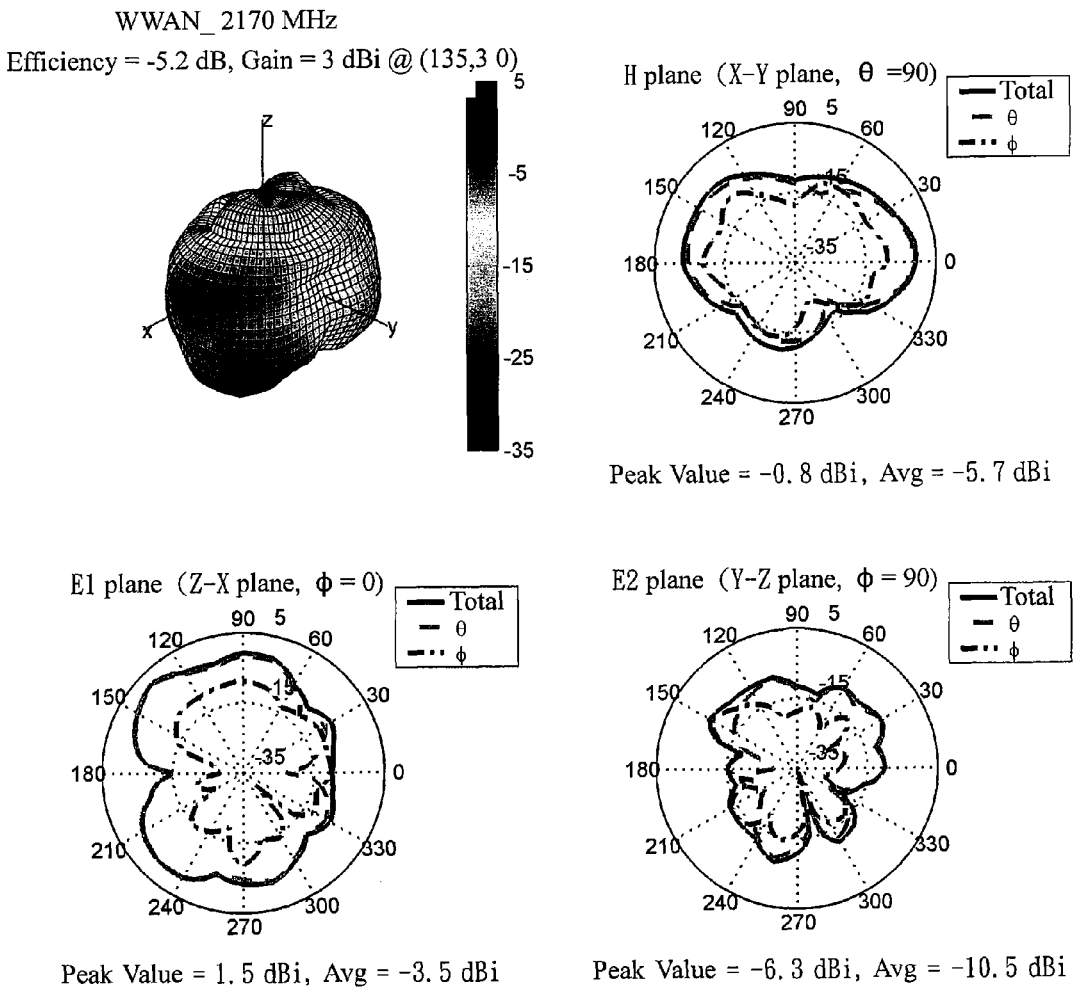
FIG. 8 illustrates radiation patterns of the preferred embodiment operating at 2170 MHz.

FIG. 4 shows VSWR values of the multi-band antenna module of this embodiment applied to the notebook computer 1. It is apparent from this figure that the measured VSWR values of the multi-band antenna module at frequencies within the first, second, and third frequency bands do not exceed 3.

According to Table 1 below, the overall radiation efficiency of the multi-band antenna module of this embodiment applied to the notebook computer 1 at frequencies within the first, second, and third frequency bands is >−5.2dB (>30.1%).

TABLE 1

| Frequency (MHz) | Efficiency (dB) | Efficiency (%) |
|---|---|---|
| 824 | −3.5 | 44.2 |
| 836.6 | −3.2 | 47.7 |
| 849 | −2.8 | 52.0 |
| 869 | −2.5 | 56.7 |
| 881.6 | −2.4 | 57.5 |
| 880 | −2.4 | 56.9 |
| 894 | −2.5 | 56.3 |
| 897.4 | −2.5 | 55.9 |
| 915 | −2.8 | 53.1 |
| 925 | −2.8 | 52.7 |
| 942.4 | −2.7 | 53.6 |
| 960 | −2.8 | 53.1 |
| 1710 | −2.0 | 62.7 |
| 1747.8 | −1.5 | 70.9 |
| 1785 | −1.8 | 65.6 |
| 1805 | −2.0 | 62.8 |
| 1842.8 | −2.1 | 62.1 |
| 1850 | −2.0 | 63.0 |
| 1880 | −1.7 | 67.0 |
| 1910 | −1.5 | 70.8 |
| 1920 | −1.5 | 70.1 |
| 1930 | −1.5 | 70.0 |
| 1950 | −1.7 | 67.8 |
| 1960 | −1.8 | 65.8 |
| 1980 | −2.1 | 61.1 |
| 1990 | −2.3 | 59.1 |
| 2110 | −4.3 | 36.7 |
| 2140 | −4.8 | 33.2 |
| 2170 | −5.2 | 30.1 |

FIGS. 5 to 8 illustrate radiation patterns of the multi-band antenna module of this embodiment. It is evident from these figures that the radiation patterns of the multi-band antenna module have relatively good omni-directionality.

To sum up, the conductor 21 forms the closed loop 20 with the grounding plane 13 and the metal frame part 121, and the closed loop 20 is coupled to and cooperates with the first radiator portion 51 of the first radiator section 5 to resonate in the first frequency band. Consequently, the metal frame portion 121 can serve as a component for transmitting and receiving signals. Additionally, the second radiator portion 52 of the first radiator section 5 is coupled to the grounding section 4 to resonate in the second frequency band, and the first radiator portion 51 of the first radiator section 5 is coupled to the second radiator section 6 for resonation and for transmitting and receiving signals in the third frequency band. Therefore, the multi-band antenna module of this invention can operate in multiple frequency bands within the WWAN communication protocol.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A multi-band antenna module adapted to be disposed in a housing of an electronic device, the housing having a grounding plane disposed therein and including a metal frame part that has two ends electrically connected to two opposite side edges of the grounding plane, said multi-band antenna module comprising:

a conductor to be coupled across the metal frame part and the grounding plane so as to cooperate with the grounding plane and a portion of the metal frame part to form a closed loop thereamong;

a substrate to be disposed in the closed loop;

a grounding section disposed on said substrate, to be coupled electrically to the grounding plane, and having a grounding point; and a first radiator section disposed on said substrate, spaced apart from said grounding section, and having a feed-in end for feeding of radio frequency signals, a portion of said first radiator section being parallel to a portion of the closed loop and cooperating with the closed loop to resonate in a first frequency band, another portion of said first radiator section being parallel to and cooperating with said grounding section to resonate in a second frequency band.

2. The multi-band antenna module as claimed in claim 1, wherein said first radiator section includes a first radiator portion extending from said feed-in end in a first direction, and a second radiator portion extending from said feed-in end in a second direction different from the first direction, said first radiator portion cooperating with the closed loop to resonate in said first frequency band, said second radiator portion cooperating with said grounding section to resonate in said second frequency band.

3. The multi-band antenna module as claimed in claim 2, further comprising a second radiator section substantially parallel to said first radiator portion and to be electrically coupled to the grounding plane, said second radiator section cooperating with said first radiator portion to resonate in a third frequency band.

4. The multi-band antenna module as claimed in claim 3, wherein said second radiator section is disposed to form a clearance with said first radiator portion.

5. The multi-band antenna module as claimed in claim 3, wherein said third frequency band ranges from 1850 MHz~2170 MHz.

6. The multi-band antenna module as claimed in claim 2, wherein said first radiator portion is disposed such that the portion of the metal frame part is parallel to and cooperates with said first radiator portion to resonate in the first frequency band.

7. The multi-band antenna module as claimed in claim 1, wherein said first radiator section is disposed to form a first clearance with the metal frame part and to form a second clearance with said grounding section.

8. The multi-band antenna module as claimed in claim 1, wherein said first frequency band ranges from 824 MHz~960 MHz, and said second frequency band ranges from 1710 MHz~1880 MHz.

9. The multi-band antenna module as claimed in claim 1, further comprising a coaxial transmission cable that has a first signal line electrically connected to said feed-in end and a second signal line electrically connected to said grounding point.

* * * * *